US007454854B2

(12) United States Patent
Riley et al.

(10) Patent No.: US 7,454,854 B2
(45) **Date of Patent: *Nov. 25, 2008**

(54) CUSHIONED WRISTBAND WITH SELF-LAMINATING IDENTITY TAG AND ADHESIVE PATCH

(75) Inventors: James M. Riley, St. Louis, MO (US); Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 440 days.

This patent is subject to a terminal disclaimer.

(21) Appl. No.: 11/224,450

(22) Filed: Sep. 12, 2005

(65) Prior Publication Data

US 2006/0059753 A1 Mar. 23, 2006

Related U.S. Application Data

(63) Continuation-in-part of application No. 10/870,500, filed on Jun. 14, 2004.

(51) Int. Cl.
*A44C 5/00* (2006.01)

(52) U.S. Cl. ..... 40/633; 283/75

(58) Field of Classification Search ..... 40/633, 40/638, 316; 283/75

See application file for complete search history.

(56) References Cited

U.S. PATENT DOCUMENTS 230,455 A 7/1880 Wilcox (Continued)

FOREIGN PATENT DOCUMENTS

EP 1039431 9/2000

(Continued)

OTHER PUBLICATIONS

Posey Movable I.D. Bracelet; downloaded from http:www.posey.com/products/4648.html on Aug. 18, 2004.

(Continued)

*Primary Examiner*—Joanne Silbermann
(74) *Attorney, Agent, or Firm*—Thompson Coburn LLP

(57) ABSTRACT

A cushioned wristband includes a carrier having a multi-layered band portion and a strap attached such as by sewing or heat welding to the back of the band portion of the carrier. The band has a surface with loop material and the strap has a surface of hook material, the hook and loop surfaces being intended to secure the band in place as it is wrapped about a patient's appendage. The strap is appropriately sized to insert through one or both of two cinch slots of a self-laminating hang tag, and pressed against the patch of adhesive to secure it to the wristband. A fixative, such a an adhesive patch with peelable label is located about in the middle of the back of the strap and is used to closely position the hang tag along the length of the strap and ensure it remains flat against the strap/wristband as the wristband is worn. Alternate fixative arrangements are disclosed including hook and loop patches, etc, located at different positions on either or both of the hang tag and strap. The hang tag may be printed with patient information and separated from a sheetlet or page sized business form processed through a printer for imaging of patient information thereon. The band portion of the carrier includes a cushioned layer of soft foamy or spongy material for contacting a patient's skin to thereby substantially eliminate any possibility for abrasion, rash, or other irritation or injury to the patient through wearing of the wristband.

22 Claims, 7 Drawing Sheets

U.S. PATENT DOCUMENTS

| | | | | | |
|---|---|---|---|---|---|
| 919,983 | A | | 4/1909 | Walsh | |
| 922,948 | A | | 5/1909 | Portmore | |
| 2,054,227 | A | | 9/1936 | Nichols | |
| 2,073,280 | A | | 3/1937 | Lederer | |
| 2,553,676 | A | | 5/1951 | Roos | |
| 2,641,074 | A | | 6/1953 | Richmond | |
| 3,197,899 | A | | 8/1965 | Twentier | |
| 3,402,808 | A | | 9/1968 | Yannuzzi | |
| 3,660,916 | A | | 5/1972 | McDermot et al. | |
| 3,854,229 | A | * | 12/1974 | Morgan | 40/638 |
| 4,004,362 | A | * | 1/1977 | Barbieri | 40/316 |
| 4,078,324 | A | | 3/1978 | Wiebe | |
| 4,179,833 | A | | 12/1979 | Knodel | |
| 4,226,036 | A | | 10/1980 | Krug | |
| 4,233,715 | A | | 11/1980 | McDermott | |
| 4,612,718 | A | | 9/1986 | Golub et al. | |
| 4,627,994 | A | | 12/1986 | Welsch | |
| 4,682,431 | A | | 7/1987 | Kowalchuk | |
| 4,696,843 | A | | 9/1987 | Schmidt | |
| 4,783,917 | A | | 11/1988 | Smith et al. | |
| 4,829,604 | A | | 5/1989 | Allen et al. | |
| 4,854,610 | A | | 8/1989 | Kwiatek | |
| 4,855,277 | A | | 8/1989 | Walter | |
| 4,914,843 | A | | 4/1990 | DeWoskin | |
| 4,941,210 | A | * | 7/1990 | Konucik | 2/171 |
| 4,956,931 | A | | 9/1990 | Selke | |
| 4,991,337 | A | | 2/1991 | Solon | |
| RE33,616 | E | | 6/1991 | Welsch | |
| 5,026,084 | A | | 6/1991 | Pasfield | |
| 5,045,426 | A | | 9/1991 | Maierson et al. | |
| 5,135,789 | A | | 8/1992 | Schmidt | |
| 5,222,823 | A | | 6/1993 | Conforti | |
| 5,227,004 | A | | 7/1993 | Belger | |
| 5,227,209 | A | | 7/1993 | Garland | |
| 5,283,969 | A | | 2/1994 | Weiss | |
| 5,311,689 | A | | 5/1994 | Lindsey | |
| 5,318,326 | A | | 6/1994 | Garrison | |
| 5,351,993 | A | | 10/1994 | Wright et al. | |
| 5,370,420 | A | | 12/1994 | Khatib et al. | |
| 5,383,686 | A | | 1/1995 | Laurash | |
| 5,418,026 | A | | 5/1995 | Dronzek, Jr. et al. | |
| 5,427,416 | A | | 6/1995 | Birch | |
| 5,486,021 | A | | 1/1996 | Laurash | |
| 5,486,436 | A | | 1/1996 | Lakes | |
| 5,509,693 | A | | 4/1996 | Kohls | |
| 5,509,694 | A | | 4/1996 | Laurash et al. | |
| 5,518,787 | A | | 5/1996 | Konkol | |
| 5,524,934 | A | | 6/1996 | Schwan et al. | |
| 5,547,227 | A | | 8/1996 | Laurash et al. | |
| 5,581,924 | A | | 12/1996 | Peterson | |
| 5,586,788 | A | | 12/1996 | Laurash | |
| 5,595,404 | A | | 1/1997 | Skees | |
| 5,598,970 | A | | 2/1997 | Mudry et al. | |
| 5,601,313 | A | | 2/1997 | Konkol et al. | |
| 5,630,627 | A | | 5/1997 | Stewart | |
| 5,637,369 | A | | 6/1997 | Stewart | |
| 5,648,143 | A | | 7/1997 | Mehta et al. | |
| 5,653,472 | A | | 8/1997 | Huddleston et al. | |
| 5,662,976 | A | | 9/1997 | Popat et al. | |
| 5,687,903 | A | | 11/1997 | Akridge et al. | |
| 5,765,885 | A | | 6/1998 | Netto | |
| 5,842,722 | A | | 12/1998 | Carlson | |
| 5,877,742 | A | | 3/1999 | Klink | |
| 5,933,993 | A | | 8/1999 | Riley | |
| 5,984,363 | A | | 11/1999 | Dotson et al. | |
| 6,000,160 | A | | 12/1999 | Riley | |
| 6,006,460 | A | | 12/1999 | Blackmer | |
| 6,016,618 | A | | 1/2000 | Attia et al. | |
| 6,053,535 | A | | 4/2000 | Washburn et al. | |
| 6,067,739 | A | | 5/2000 | Riley | |
| 6,071,585 | A | | 6/2000 | Roth | |
| 6,092,321 | A | | 7/2000 | Cheng et al. | |
| 6,155,476 | A | | 12/2000 | Fabel | |
| 6,155,603 | A | | 12/2000 | Fox | |
| 6,159,570 | A | | 12/2000 | Ulrich et al. | |
| 6,303,539 | B1 | | 10/2001 | Kosarew | |
| 6,331,018 | B1 | | 12/2001 | Roth et al. | |
| 6,343,819 | B1 | | 2/2002 | Shiozaki | |
| 6,361,078 | B1 | | 3/2002 | Chess | |
| 6,409,871 | B1 | | 6/2002 | Washburn et al. | |
| 6,438,881 | B1 | | 8/2002 | Riley | |
| 6,510,634 | B1 | | 1/2003 | Riley | |
| 6,517,921 | B2 | | 2/2003 | Ulrich et al. | |
| 6,611,962 | B2 | * | 9/2003 | Redwood et al. | 2/160 |
| 6,685,228 | B2 | | 2/2004 | Riley | |
| 6,748,687 | B2 | | 6/2004 | Riley | |
| 6,807,680 | B2 | | 10/2004 | Sloot | |
| 6,836,215 | B1 | | 12/2004 | Laurash et al. | |
| 6,863,311 | B2 | | 3/2005 | Riley | |
| 7,017,294 | B2 | | 3/2006 | Riley | |
| 7,047,682 | B2 | | 5/2006 | Riley | |
| 7,222,448 | B2 | | 5/2007 | Riley | |
| 7,240,446 | B2 | | 7/2007 | Bekker | |
| 2002/0176973 | A1 | | 11/2002 | Keiser | |
| 2004/0060216 | A1 | | 4/2004 | Riley | |
| 2005/0108912 | A1 | | 5/2005 | Bekker | |
| 2005/0279001 | A1 | | 12/2005 | Riley | |
| 2006/0230661 | A1 | | 10/2006 | Bekker | |
| 2006/0236578 | A1 | | 10/2006 | Saint et al. | |
| 2007/0089342 | A1 | | 4/2007 | Jain et al. | |

FOREIGN PATENT DOCUMENTS

| | | | |
|---|---|---|---|
| FR | 2806594 | A | 9/2001 |
| GB | 960859 | | 6/1964 |
| GB | 2045718 | | 11/1980 |
| GB | 2160492 | | 12/1985 |
| GB | 2228915 | A | 9/1990 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | WO 96/12618 | | 5/1996 |
| WO | 98/23081 | | 5/1998 |
| WO | 99/18817 | | 4/1999 |
| WO | 02/039412 | | 5/2002 |
| WO | 03/00331 | | 1/2003 |
| WO | 04/028826 | | 4/2004 |
| WO | 05/064574 | | 7/2005 |
| WO | 06/007356 | | 1/2006 |
| WO | 07/021375 | | 2/2007 |

OTHER PUBLICATIONS

Avery Dennison SuraCard™.
Avery® Laminated Identification Cards #5361.
Brochure entitiled: "Color-Bar® Click Strip™ Label System"; Smead Maufacturing company; Date Unknown; Form No. SSS-CS-00.
Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions®; Date Unknown; Form No. SSS-RC1-00.
Sample of Standard Register Labels.
Standard Register, *P.S. Magazine*, Fall 1998, Dayton, Ohio.
Gretchen Berry, "Wrist Watch," *Advance for Healthcare Information Professionals*, Feb. 15, 1999.
Sample of Standard Register Label.

"Yes, Sir, That's My Baby!," *Material Management in Health Care*, Feb. 1999, vol. 8, No. 2, Health Forum, Inc.
Disater Management Systems, Inc., Triage Tag, Copyright 1996, Pomona, California.
Maryland Department of Transportation, Maryland Emergency Medical Services. Triage Tag, Copyright MIEMMS 1999, Maryland.
ID Warehouse (http://web.archive.org/web/20050131235601/http://dwarehouse.com/) Jan. 31, 2005, p. 1: WB1908, Stock Vinyl Wristland.

* cited by examiner

CUSHIONED WRISTBAND WITH SELF-LAMINATING IDENTITY TAG AND ADHESIVE PATCH

CROSS REFERENCE TO RELATED APPLICATIONS

This application is a continuation-in-part of Ser. No. 10/870,500 filed Jun. 17, 2004, the disclosure of which is incorporated herein by reference.

BACKGROUND AND SUMMARY OF THE INVENTION

The inventor herein has previously invented multiple designs for self-laminating wristbands principally for use with patients in a medical or hospital setting. Examples of these may be found in his previously-issued U.S. Pat. Nos. 5,933,993; 6,000,160; 6,067,739; 6,438,881; 6,510,634; and 6,685,228 along with other patent applications pending for further designs, improvements, and inventive techniques and methods relating thereto, the disclosures of which are incorporated herein by reference. Included among these various inventions and designs are self-laminating wristbands intended for use with newborn babies including those delivered prematurely. As is well known, these babies and especially premature babies have extremely sensitive skin in many instances so that any wristband or other object placed around the baby's wrist or ankle must carefully allow for that sensitivity. Furthermore, babies are well known to move their arms and legs in a herky-jerky or flailing fashion, rub their eyes, and otherwise move about as they experience the new world that they have entered. In many instances, these newborn babies can become agitated and cry which can have a tendency to accentuate or intensify their arm and leg movements. Of course, as their hands, arms and legs move, they come in contact with other sensitive areas, such as, for example, their face, which could in some instances become scratched and in rare instances even injure the baby.

The inventor's previous designs include wristbands intended for these smaller babies including babies which might even be in intensive care and various features are provided to greatly minimize any possibility of discomfort, rash, or other injury to occur. Nevertheless, despite the great commercial success and widespread adoption and use of the inventor's wristband inventions, which have provided a significantly safer wristband for use with these babies, the inventor has continued his efforts to improve upon these designs even further so as to completely eliminate even the slightest possible chance of irritation or injury to the baby.

As a result of his continuing efforts, the inventor herein has succeeded in designing and developing a cushioned wristband which makes it virtually impossible for a baby, or indeed any patient, who wears this wristband to experience a rash, discomfort, or even any injury as a result of the patient's boisterous conduct. In simple terms, this latest invention of a cushioned wristband includes a cushioned carrier for extending around the patient's wrist or ankle with a fastening strap preferably sewn to and extending from one side thereof. The strap preferably has one surface covered with Velcro™ hook-type fastener material while the carrier has a surface covered with Velcro™ loop material. The opposite surface of the carrier which comes into contact with the patient's skin is preferably any hypoallergenic, soft, cushioning material. The strap is preferably sized to thread through a self-laminating tag which may be processed through a laser printer and is similar in construction to many of the inventor's previous wristband designs. In essence, this self-laminating tag preferably comprises an imaging area of face stock material and an underlying self-laminating portion approximately twice the size of the imaging area with cinch slots preferably positioned in the lamination and preferably on either side of the imaging area. While the strap passing through the cinch slots comprises the primary means for securing the label to the strap and thus the wristband, an adhesive patch on the top of the strap, or alternatively on the back of the id tag or both, stabilizes the id tag in relative position to the strap by closely adhering it to the back of the strap. Without the patch of adhesive, the id tag could shift around on the strap or bunch or kink, due to what might be a small circumference of a patient's wrist around which the id tag must wrap or the continued use of the wristband which exposes it to the thrashing about that a patient may do, or due to other reasons. This is particularly so with baby patients who have small wrists and a tendency to thrash about. As the patch of adhesive merely functions to "affix" or "position" the id tag with respect to the strap/carrier, means other than a layer of adhesive is contemplated for use herein. For example, a hook/loop fixative could be used, arranged in a myriad of ways, and used to fixate the id tag to either or both of the strap and cushioned carrier. One such way would be to merely affix a patch of hook material to the back of the id tag so that after it is slipped onto the strap and the strap is wrapped about the cushioned carrier, not only the strap hook surface but also the hook surface of the id tag would come into contact with the loop material on the back of the cushioned carrier thereby fixating it in place flat against the strap/cushioned carrier.

In use, the tag may be processed through a laser printer for printing with the patient's name, doctor's name, a barcode identifier, date of admission, and any other information as desired. The tag may then be separated from a sheetlet sized or page sized or other conveniently sized business form, the lamination folded over to self laminate the tag, and then applied to the carrier by inserting the strap through one of the cinch slots, removing the protecting covering of the adhesive to expose an underlying surface of adhesive, pressing the tag against the adhesive to adhere and thereby closely position it, and inserting the strap through the second slot. Once fully assembled, the wristband may then be wrapped around the baby's wrist and the strap affixed to the back of the carrier by joining the hook and loop material of a Velcro™ fastener to thus secure the wristband to the baby. Preferably, the wristband is sized to allow for the cushioning material to wrap entirely around the baby's wrist, ankle, etc., and preferably overlap so that just the cushioning material contacts the baby's skin.

A somewhat similar prior art device is shown in FIG. 1. It comprises a wristband 100P made of cushioning material 102P with a backing of Velcro™ loop material 104P, with a short strap 106P sewn to one side thereof and having a Velcro™ hook material 108P arranged for securing the wristband. Sewn on the back of the wristband is a panel 110P to which a patient label 112P may be adhered. This patient label 112P may be provided as part of another form and printed such as by processing through a laser printer. It is noted that the patient label is exposed and not laminated, thereby requiring it to be made of a resilient material such as a vinyl or other durable material to withstand the moisture, body fluids and other abuse it will receive. Furthermore, there is no positive or mechanical attachment of the patient label to the wristband so that as it becomes worn and abused, the patient label is likely to become illegible or even detach which could lead to failure of the wristband in its essential purpose of reliably identifying the baby. With the wristband of the present invention, the cinch slots provide a positive mechanical attachment of a laminated patient label which makes it virtually impossible for it to become illegible or detached, thereby providing dramatically improved performance. Additionally, the patch of adhesive reliably adheres the id tag in a flat orientation against the cushioning and eliminates any tendency for the id tag to "kink" or form sharp corners. Furthermore, the wristband may be removed and the adhesive patch ensures that the id tag does not fall off the wristband by unintentionally slipping through the cinch slots. The prior art patient label is not conveniently removed for refreshing the patient label with a new one, and instead it is thought that a new patient label would need to be adhered over the top of the existing patient label. This construction leads to attachment of a second patient label in a manner less secure than the original, unless extreme care is taken to prepare the panel for receiving the new patient label which is unlikely to happen in the hospital environment. Nurses have better things to do with their time than clean and prepare surfaces for receiving a new patient label. With the present invention, refreshment of id tag is rarely necessary, but if necessary, can be achieved in a few steps by removing the wristband, peeling the id tag from the adhesive patch, sliding off the old id tag and sliding on the new one, re-adhering the id tag to the adhesive patch, and then replacing the wristband back on the baby. No cleaning of a surface, or re-applying of an adhesive, is required. Furthermore, the replacement patient label is secured almost as well as the original patient label, depending on the characteristics of the adhesive chosen for the adhesive patch. A less aggressive adhesive would facilitate replacement of id tags without significant loss of adhesion although the level of adhesion would not be as great should a more aggressive adhesive be chosen for use. For those applications where replacement of id tags is not contemplated, a more aggressive adhesive would be preferable. Less aggressive adhesives would be preferable should replacement of the id tag be contemplated, such as when it is desirable for cost or other reasons to re-use the underlying cushion band. The present invention thus represents a dramatic step forward over the prior art construction disclosed herein.

There are many new features and advantages provided by the present invention. Some of these include the following. The self-laminating tag may be conveniently provided on a sheetlet or full-page size form for convenient processing through a laser printer at the time of admission along with other forms including other wristbands and labels as may be later used for the baby. Or, a laminating id tag portion of a full wristband may have its strap cut off to harvest it for use with the cushioning band. Thus, the advantages as noted in the inventor's prior patents are carried forward with this invention in that regard. The self-laminating tag may be firmly secured either loosely or closely about the baby's wrist or ankle with only a cushioning material contacting the baby's skin to thereby provide reliable identification with a durable tag yet without any discomfort to the baby. The carrier is adjustable as it can be wrapped around itself to provide a variable length so that it may be used with patients of different size or age. In other words, the wristband carrier is sized and arranged with its hook and loop fastener to be adjustable in length and fit either loosely or tightly to the patient's appendage. The hang tag may be attached with either one or both of the cinch slots, as desired. If attached with a single cinch slot, the tag in essence is free to move with respect to the wristband and thereby be more readily accessible and remain flat for easier bar code scanning. If attached with the strap extending through both slots, the tag may be secured more tightly against the strap/carrier and adhered with the adhesive patch, be reliably positioned along the length of the strap/carrier, be less likely to kink or bunch up away from the strap/carrier, be less subject to inadvertent detachment, and be less likely to be inadvertently brought into contact with the baby. More specifically, the adhesive patch provides the advantage of closely adhering the length of the id tag to the cushioned band, thereby minimizing any tendency of the id tag to "kink" or buckle to form sharp corners or separate from the band and be available to possibly injure the baby as he/she thrashes about, as babies commonly do. The patch also serves to reliably position the id tag along the length of the strap so that it doesn't slide around. These advantages makes it easier to read any information printed on the label as the wristband is used and would otherwise tend to experience wear and tear or mis-alignment.

The wristband is relatively inexpensive yet durable and flexible in that, should a tag be desired to be changed as a result of heavy abuse, it may be conveniently done without reprocessing through a printer or the like in many instances as additional tags may be conveniently printed at the time of admission. By being self laminating, the tag is protected from the various bodily fluids likely for it to come in contact with as the baby is fed or administered medicine orally, the baby drools, and the baby otherwise performs its bodily functions. If used as a hang tag, it is more readily detachable, and the carrier may be reused as desired such as in shortage or emergency situations thereby making the entire wristband system more flexible. Indeed, the carrier may itself be washed and re-used in that same regard. The hang tag may be provided as part of a larger assemblage of wristband forms such that a single set of forms may be preprinted and available for usage as the baby's stay progresses and even to accommodate those relatively small percentage of occasions when the baby is kept for an extended stay.

While the principal advantages and features of the invention have been briefly described above, a more thorough understanding and appreciation for the invention and its advantages may be obtained by referring to the drawings and description of the preferred embodiment which follow.

DETAILED DESCRIPTION OF THE PREFERRED EMBODIMENT

Figure 2:
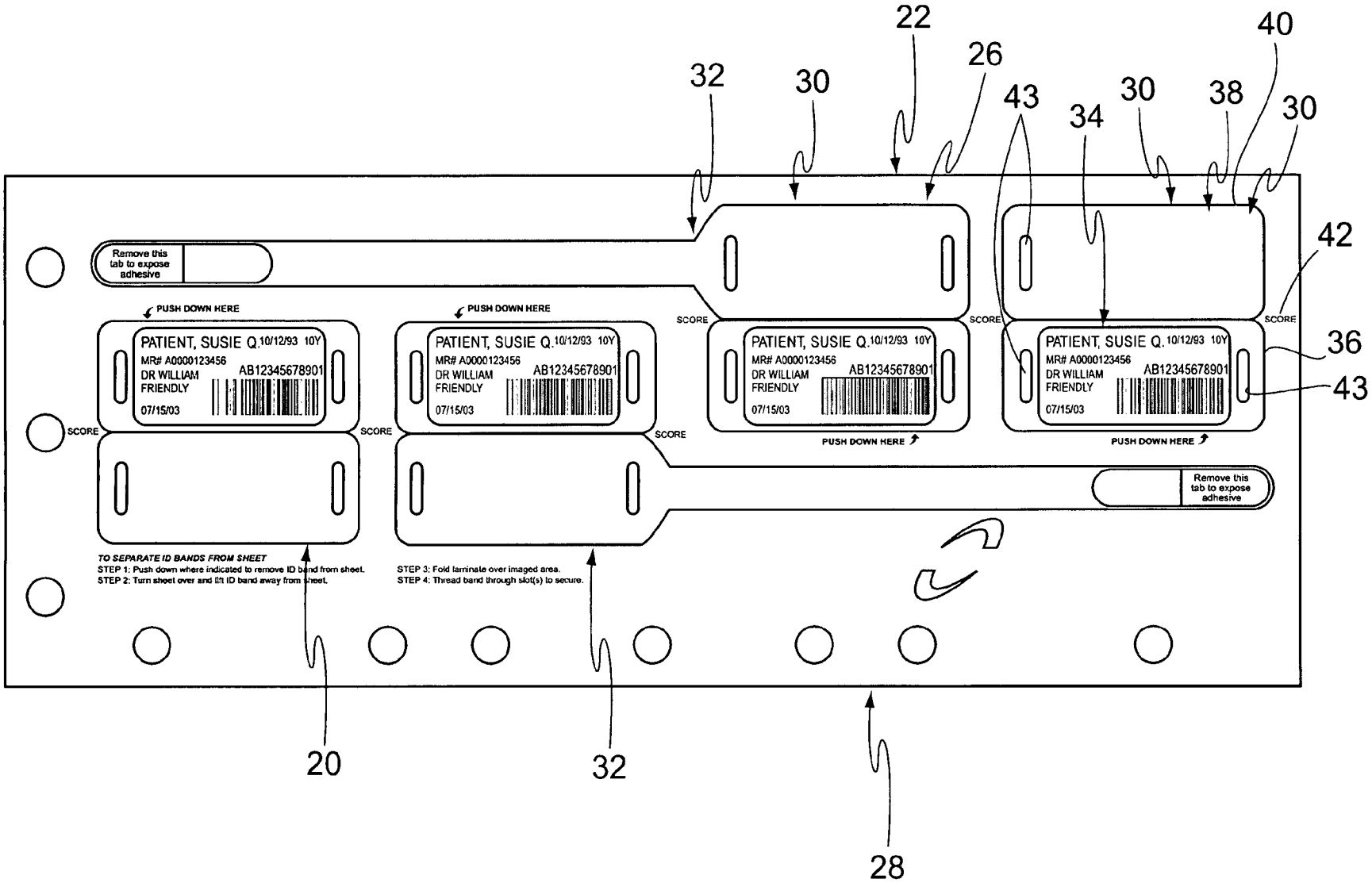
FIG. 2 is a top view of a sheetlet sized business form having a pair a self-laminating wristbands and a pair of self-laminating hang tags for use with the cushioned carrier as shown in FIG. 4.
Figure 3:
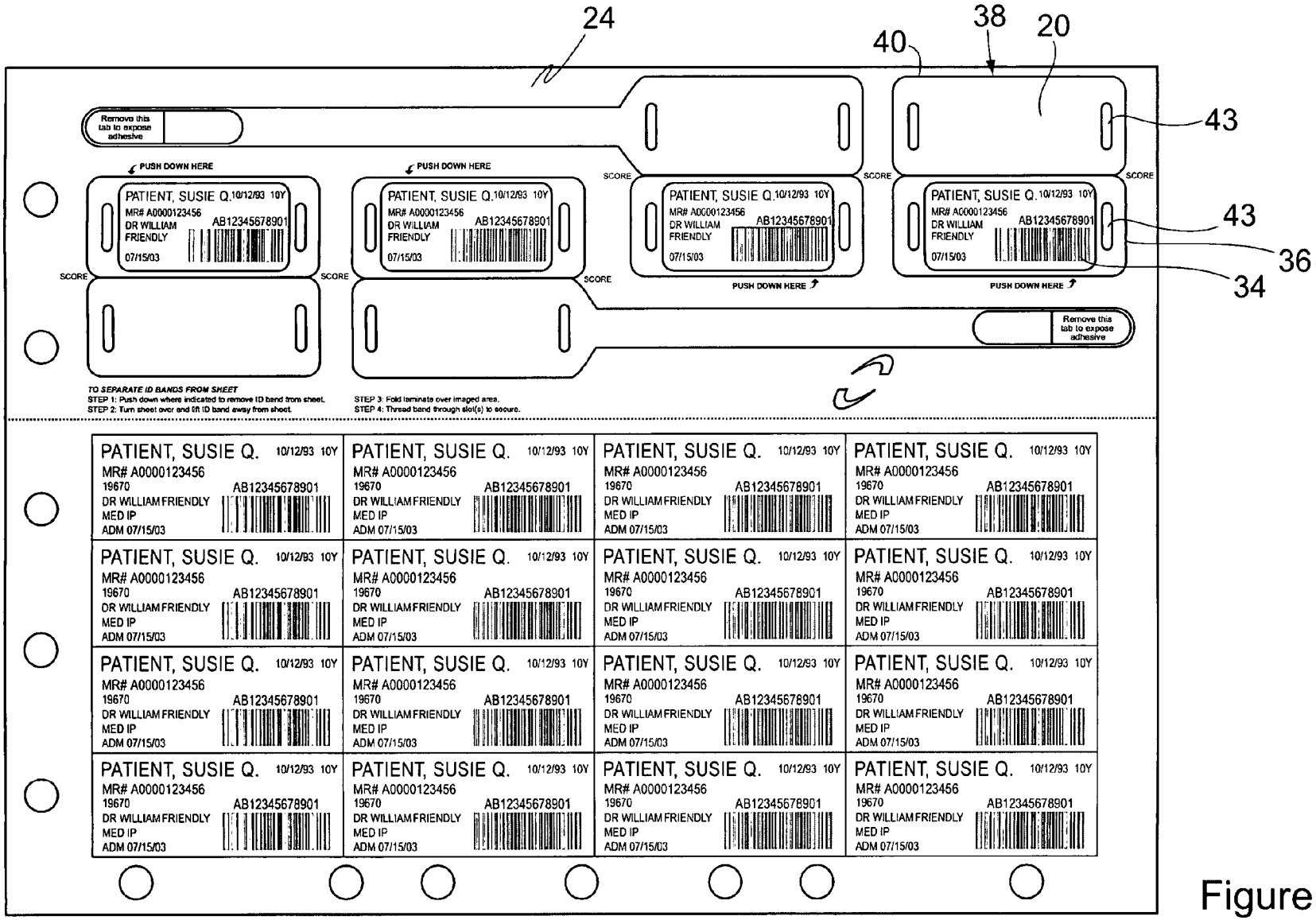
FIG. 3 is a top view of a full-page sized "combo" form having an upper portion containing a pair of self-laminating wristbands as well as a pair of self-laminating hang tags and a bottom portion having a matrix of printable self-adhesive labels.

As shown in FIGS. 2 and 3, the self-laminating hang tag or id tag 20 is provided as part of a multi-web business form shown as a sheetlet 22 in FIG. 2 or a page sized combination form 24 as shown in FIG. 3. The sheetlet 22 is approximately envelope sized for convenient processing through a laser printer, as is known in the art and as explained in the inventor's prior patents mentioned above. The sheetlet 22 is generally comprised of two plies, an upper face ply 26 joined to an underlying laminate ply 28, the self-laminating portions of which are shown in outline 30 on the sheetlet 22. A pair of hang tags 20 as well as a pair of self-laminating wristbands 32 are conveniently sized to fit within the confines of the sheetlet 22. Of particular interest for purposes of the present invention are the hang tags 20, although is readily apparent that the wristbands 32 could have their straps cut off to make additional hang tags 20. Each of these include an imaging area 34 defined by a die cut 36 in the face stock layer 26 and an underlying laminating portion 38 defined by a die cut 40 in the laminate layer 28. A pair of cinch slots 43 are preferably provided in the laminating portion 34 and straddling the imaging area 34. These cinch slots are used to attach the hang tag 20 to the carrier 44, as is explained below in greater detail. As shown in FIGS. 2 and 3, the cinch slots 43 may be approximately 7/16 inches long by approximately 1/16 inches wide and spaced approximately 1¾ inches apart, or otherwise appropriately sized to allow for the hang tag 20 to be slidingly attached, as explained below. More particularly, the inventor contemplates that the cinch slots 43 should be preferably sized so as to minimize the possibility for the hang tag 20 to shift once the wristband has been applied to the baby. The self-laminating hang tag 20 is conveniently separated from the sheetlet 22 and the lamination portion 38 is folded about a score line 42 to completely encapsulate the imaging area 34. Of course, the imaging area 34 may be processed through a laser printer and printed with patient information upon admittance of the patient or, as with the case of a baby, birth of the baby. In addition to being provided in sheetlet 22 form, the wristbands 32 and hang tags 20 may also be provided as part of a page sized combo form 24 as shown in FIG. 3. The construction of the combo form 24 is explained in greater detail in one or more of the inventor's prior patents as mentioned above.

Figure 1:
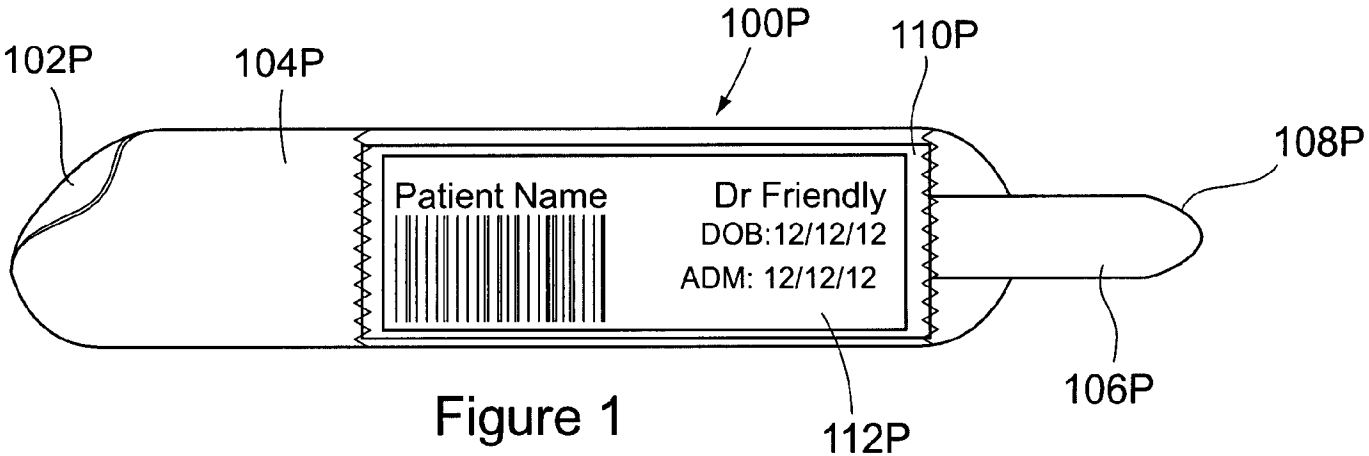
Figure 1 PRIOR ART
FIG. 1 is a plan view of a prior art wristband and label having a cushioning material carrier.
Figure 4:
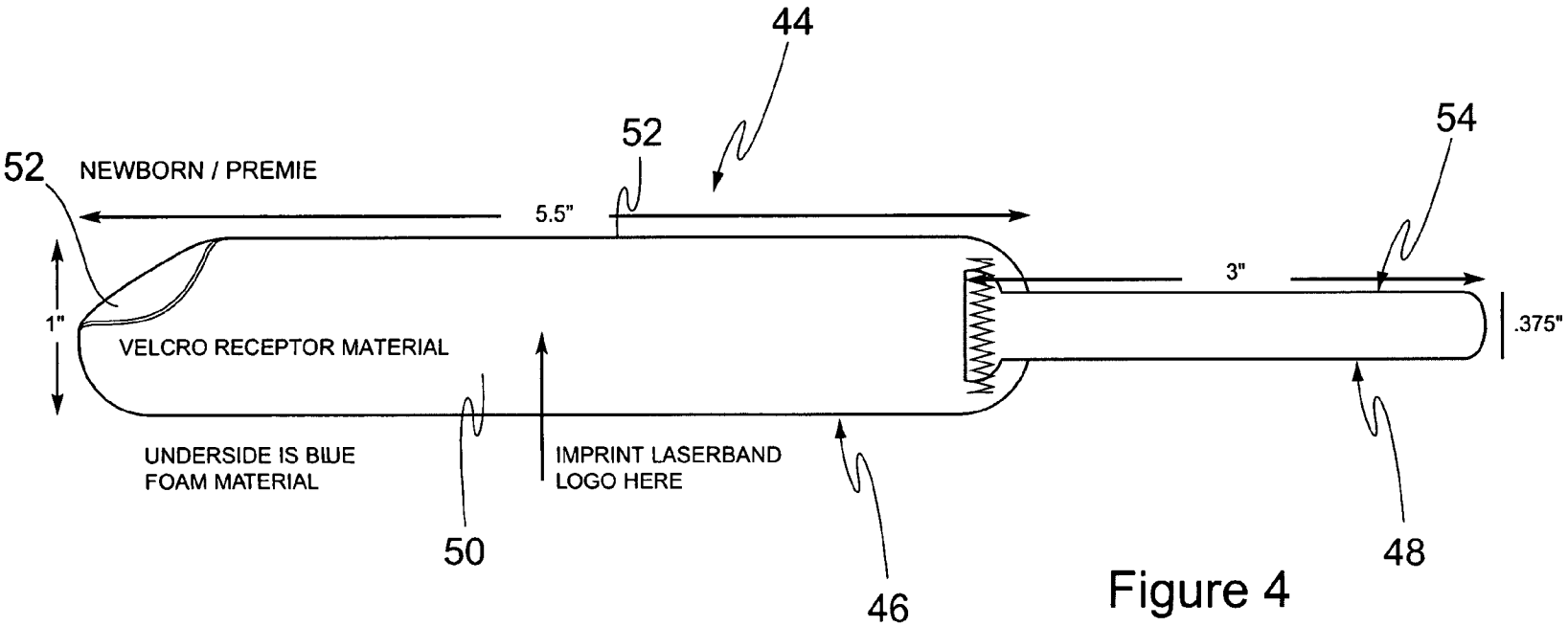
FIG. 4 is a top view of the cushioned carrier depicting the Velcro™ strap sewn to one side thereof for attachment of the self-laminating hang tags depicted in FIGS. 2 and 3.
Figure 8:
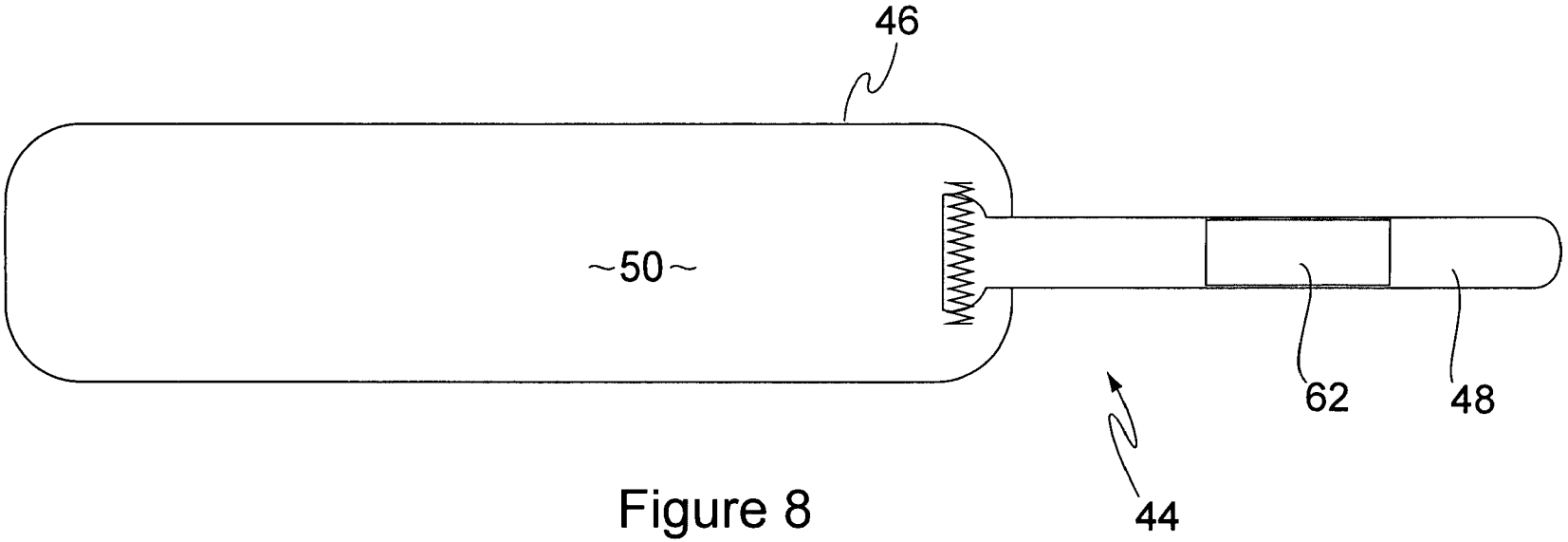
FIG. 8 is a top view of the cushioned carrier depicting the adhesive patch covered with a protective label.
Figure 9:
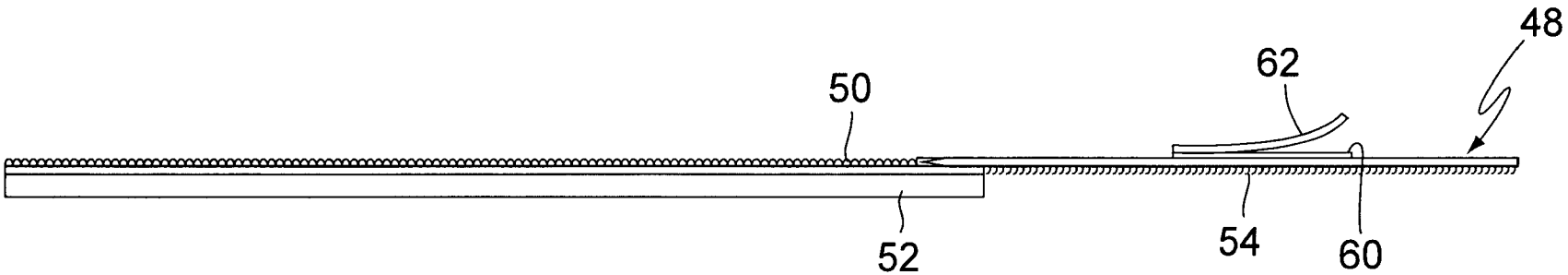
FIG. 9 is a side view depicting in further detail the hook and loop fastening layers, the adhesive patch with its label partially peeled away.

The carrier 44 is shown in FIGS. 4, 8 and 9. It includes a band portion 46 and a strap portion 48. The band portion 46 is of multi-layer construction with a top layer 50 of the "loop half" of a Velcro™ fastener material and a bottom layer 52 of a cushioned material which is preferably any soft foam or sponge-like material which may also be of surgical grade. The Velcro™ strap 48 has a lower surface 54 comprised of the "hook half" of a Velcro™ fastener such that as the carrier 44 is wrapped around a baby's wrist, the Velcro™ hook surface 54 may be brought to overlie the Velcro™ loop surface and attach the two ends of the carrier 44 and complete the wristband.

As shown in the preferred embodiment, the strap portion may be preferably sewn on to the end of the carrier or band portion 46 and be approximately 3 inches long by ⅜ inches wide. Alternatively, the strap portion may be attached to the band portion 46 by either an adhesive or heat weld method, or other method as known in the art. The hang tag cinch slots 43 are sized appropriately to receive and pass the strap portion 48 therethrough and allow an end of the strap portion 48 to extend beyond the second cinch slot 43 for exposure to the loop portion 50.

Figure 5:
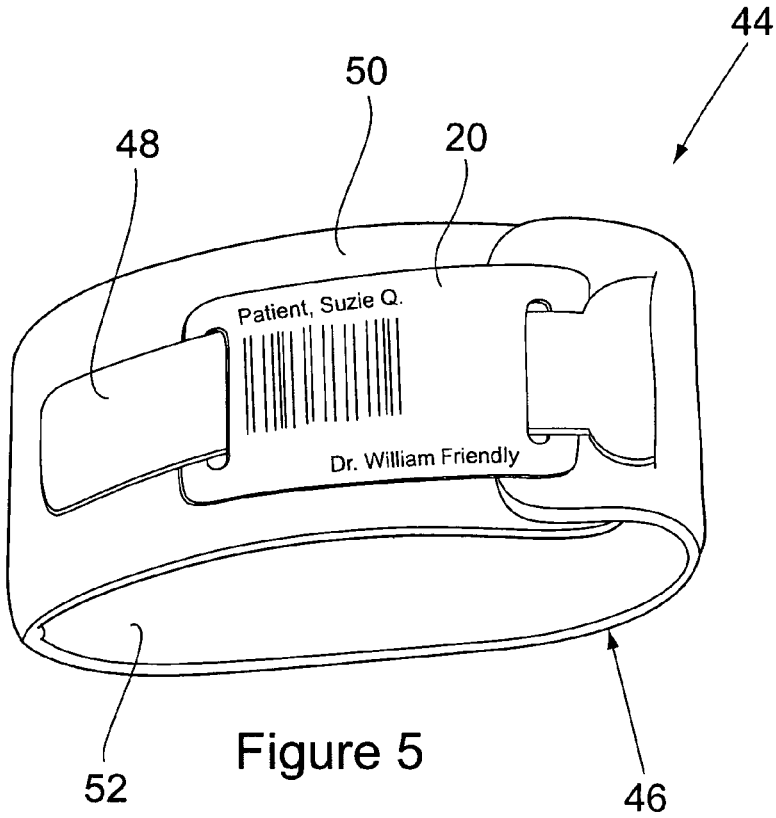
FIG. 5 is a perspective view of an assembled wristband with the strap threaded through both of two cinch slots.
Figure 6:
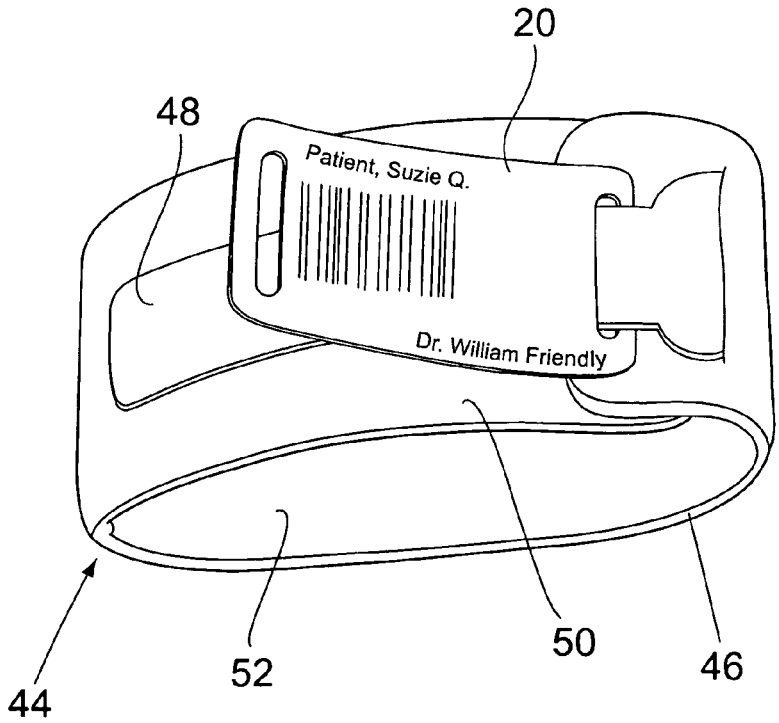
FIG. 6 is a perspective view of an assembled wristband with the strap threaded through one of the cinch slots.

In use, the hang tags in the form of a sheetlet or page sized form are conveniently processed through a laser printer or the like at which time the patient's name or other identifying information is applied to the imaging area. A hang tag may then be separated from the sheetlet or page sized form, and the carrier strap inserted through one or both of the cinch slots. As shown in FIG. 5, the hang tag may be positioned on the strap so that the extra length of the strap extends beyond the outboard cinch slot so that the maximum size "tongue" extends beyond for attachment to the loop material on the back of the carrier. Also, in FIG. 5 the carrier is shown as overlapping so that only the cushion material forming the carrier contacts the patient's skin. This arrangement is similarly shown in FIG. 7. With this arrangement, it is thought that maximum comfort is provided to the patient as the carrier may be "snugged" about the wrist, or ankle, so as not to be too tight but to be firmly secured and yet just the cushion material is softly compressed against the skin. A second configuration is shown in FIG. 6, as the strap is threaded through only one of the two cinch slots. Although FIG. 6 shows the strap inserted through the inboard cinch slot, the strap may be similarly inserted through the outboard slot, depending on the choice of the nurse. One or the other of the slots might be chosen to facilitate access to a bar code on one side or the other of the hang tag, for example, or for any other reason including merely personal preference. Again, in FIG. 6 as in FIG. 5, the carrier is shown as overlapping, for maximum comfort. However, the carrier could be arranged to not overlap, for example should a longer length wristband be needed, although that application is not contemplated by the inventor as preferable as it possibly exposes rough edges and surfaces to the patient's skin.

Figure 7:
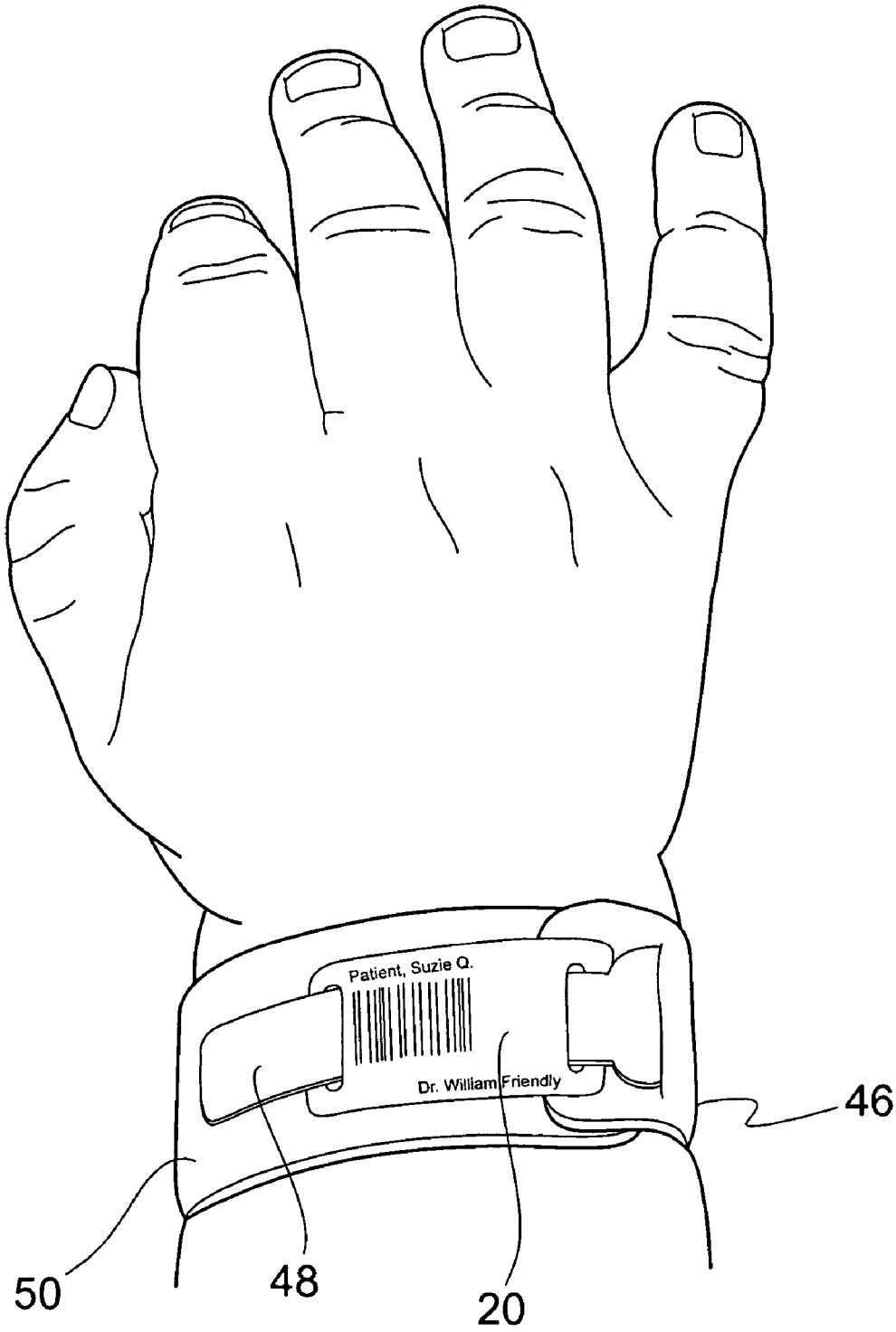
FIG. 7 is a perspective view of an assembled wristband applied to a patient's wrist.

As shown in FIG. 7, the wristband is conveniently arranged to encircle the patient's wrist, and may be "snugged" against the wrist to hold it in place, with the information on the hang tag exposed for ready viewing and access for example to read a bar code imprinted thereon. With this arrangement, the wristband will resist unintentional migration or movement which would obscure the patient information. However, as noted above, the length of the wristband compared to the size of the patient's appendage will in some cases limit the choice for applying the wristband in this overlapping configuration or not. While a short gap between the two ends of the carrier might well be acceptable due to the relative thickness of the carrier, too long a gap would potentially expose the "hook" surface of the strap to the patient's skin as well as shorten the amount of strap hook surface contacting the loop surface which might compromise the integrity of the attachment. Therefore, while the design of the wristband does provide some adjustability, some care must be used in choosing the right size wristband for the particular patient.

Figure 10:
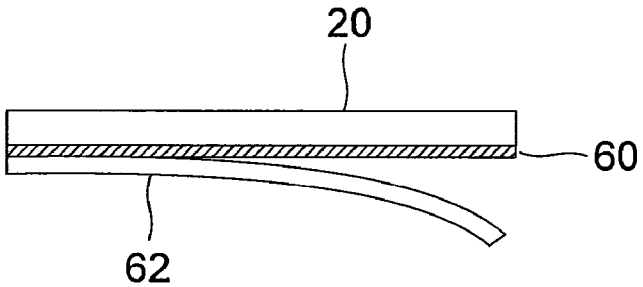
FIG. 10 is a side view of a label depicting a fixative (adhesive) applied along its length.
Figure 11:
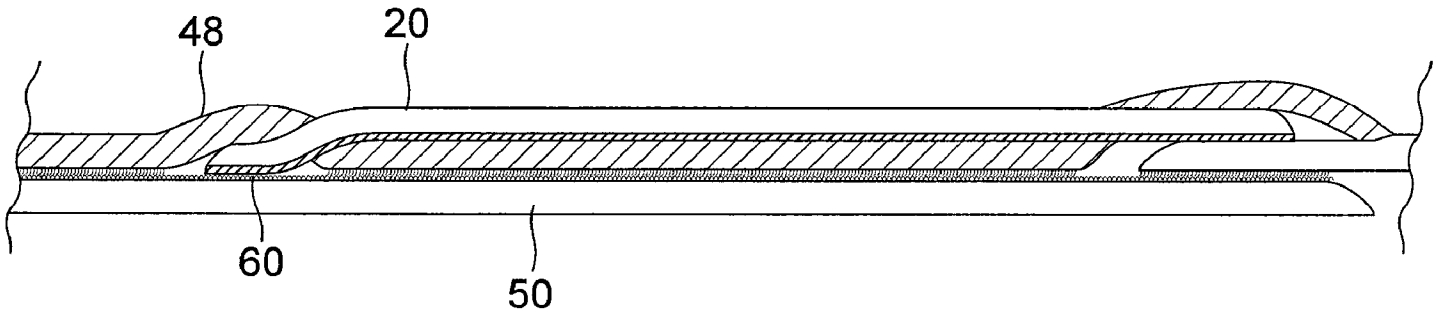
FIG. 11 is a partial side view of a label spaced above a cushioned carrier depicting a patch of adhesive interposed between the label and cushioned carrier as well as the strap.

An improvement to the basic design of the cushioned wristband is depicted in FIGS. 8 and 9. As shown therein an adhesive patch 60 is situated along the length of the strap 48, and at a mid-point so that as the strap 48 is wrapped about the baby's wrist it underlies the hang tag 20. A protective, peel off label 62 covers the adhesive patch 60, as best shown in FIG. 9. Although preferably positioned on the back of the strap 48, a layer of adhesive may alternatively or additionally be provided on the back of the laminated hang tag 20. The laminated tag may be conveniently formed in its carrier with a separable patch of laminate to thereby expose an underlying layer of adhesive on the back of the face stock, or another arrangement could be provided to allow for an exposed patch of adhesive to be present on the laminated hang tag after separation and assembly from its carrier. Other examples include using a separately applied patch of material having an exposed layer of adhesive, although this would add another step in the preparation of the hang tag 20 before being attached to the strap. As shown in FIG. 10-11, this exposed layer of adhesive could be applied along the length of the label so that it would be interposed between the label and the cushioned carrier alone or between the label and both of the cushioned carrier and the strap.

There are variations of this arrangement for the adhesive patch and peelable label covering which fall within the teachings of the present invention. For example, other kinds of fasteners could be substituted for the adhesive patch including even a hook and loop arrangement. The id tag could itself include a patch of adhesive arranged in its back surface, even include a removable layer of laminate or the like to protect the adhesive until its desired exposure for use. This arrangement for the id tag could be designed into the business form from which the id tag is separated. A separate adhesive or attachment arrangement might be employed, such as a double sided adhesive patch, which could be separate from the strap or id tag, and which could be applied before assembling the id tag and strap. Still other arrangements could be thought of, as would be apparent to those of skill in the art, given the inventor's teachings as disclosed herein. The principal design feature of the adhesive patch is to secure the id tag and along a length thereof to the strap to more completely secure it so that it remains in position and flatter against the strap as the wristband is worn.

In use, the hang tag or id tag is first prepared by separating it from the carrier sheet and laminating it in the manner described above and in the prior patents referenced herein. The strap portion is then inserted through one of the cinch slots in a downward direction so that the strap extends beneath the imaged area of the id tag. The peel off label is then removed from the adhesive patch, the strap is inserted up through the second slot and the id tag is firmly adhered to the strap by pressing it against the adhesive patch. The cushioned wristband may then be attached to a baby's wrist, leg or ankle as described above. Alternately, as with the parent invention, the strap may be inserted through only one slot in the id tag so that the id tag has one end loose end. In that instance, the adhesive patch is not used and instead remains in place for later use, as desired.

The invention has been described in terms of a preferred embodiment as shown in the drawings and described above. However, the invention should not be considered as limited to the specifics of this preferred embodiment as various changes and alternatives to the specific disclosure would be apparent to those of skill in the art and are included within the teaching of the invention. For example, various kinds of materials may be used for the band portion of the carrier, various dimensions and lengths can be chosen as convenient for the various portions of the carrier such as the band and the strap, the strap may be secured to the band portion by any convenient attachment means including a hook-and-loop fastener, snap, adhesive, heat welding, etc., the hang tag could be preprinted with information desired to be included, such as special precaution conditions or other warnings or indications relating to the medical condition or treatment of the patient, a cinch slot could be provided on only one side of the hang tag instead of both sides or moved to different areas on the hang tag, a wristband could function as a hang tag by cutting off the strap portion, and other similar changes. Furthermore, although explained as intended for principal use for baby patients, the wristband of the present invention may also be used for any patient for increased comfort and reduced risk of abrasion, rash, or unintentional injury for those patients with skin integrity issues such as burn victims, elderly patients, etc. If desired for use with adults or larger patients, the dimensions of the various parts of the cushioned wristband would be appropriately adjusted as would be apparent to those of ordinary skill in the art, given the inventor's teaching contained herein. Although the invention has been disclosed in its preferred embodiment as comprising a patch of adhesive, alternate means for attaching the id tag to the strap, or cushioned carrier, are within the scope of the present invention. For example, a patch of a hook fastener material may be attached to the back of the laminated label and adhere to the loop material forming the back of the cushioned carrier as the strap is wrapped about the wrist during application of the wristband to a patient. This arrangement would attach the label directly to the cushioned carrier instead of the strap, or to both depending on the particular arrangement chosen and if the strap had a layer of loop material applied to its back. As such, the present invention should only be considered as limited by the scope of the claims appended hereto and their legal equivalents.

What is claimed is:

1. A cushioned wristband with printable laminated label, said wristband comprising a layer of cushion material for contacting the wearer's wrist, a strap extending to one side of said cushion material, a laminated label for attachment to the wristband, said laminated label having at least one slot through which said strap may be inserted, an attachment for securing the strap so that it remains inserted through the at least one slot, and a fixative for closely positioning said strap to said label.

2. The wristband of claim 1 wherein the fixative comprises a patch of adhesive applied to the strap.

3. The wristband of claim 2 wherein the attachment comprises a layer of one of either hook or loop material backing covering at least a portion of the cushion material, and wherein the strap has a surface of the other of the hook or loop material.

4. The wristband of claim 3 wherein the label has a pair of slots, one on either side thereof, and wherein the strap is sufficiently long to be inserted through each of said slots and beyond to be adhered by said adhesive patch to the label as the wristband is applied to a user.

5. The wristband of claim 4 wherein the label comprises a printable face stock portion and a laminating portion, said laminating portion being approximately twice the size of said printable face stock portion so that the laminating portion may be folded over to substantially self laminate the face stock portion.

6. The wristband of claim 5 wherein the backing layer is loop material and the strap is hook material.

7. The wristband of claim 6 wherein the label is separable from a two-layer business form, the form being arranged for printing of the face stock portion by a printer under computer control prior to separation from the form.

8. The wristband of claim 7 wherein the strap is attached to the loop material and arranged so that after insertion through at least one of the label slots the strap may be wrapped around the user's wrist and past the opposite edge of the wristband for attachment to the backing so that the user's wrist is completely encircled by the cushion material and the label is located outside the wristband.

9. A cushioned wristband including an information bearing label, the wristband having a carrier comprised of an inside layer of cushion material and an outside layer of either hook or loop material, and a strap affixed near an edge of the carrier, the strap having a layer of the other of either the hook or loop material applied to a first side thereof and a fixative applied on the other side of the strap, the strap being inserted through at least one slot formed in the label to thereby position the label to contact the fixative and thereby become affixed thereto and the wristband then wrap around the user's wrist for attachment of the strap to the outside layer as the wristband is applied to a user's wrist.

10. The wristband of claim 9, said label comprising a self laminating label formed from two plies of material, said two plies comprising a face ply area for receiving a printed image and a laminating ply for over-laminating the face ply area.

11. The wristband of claim 10 wherein the laminating ply includes two slots, the two slots being arranged on opposing sides of the face ply area so that the fixative contacts and affixes to the non-imaged side of the face ply area.

12. The cushioned wristband of claim 11 wherein said outside layer is loop material and the strap is hook material, and wherein the carrier is elongated and the strap is affixed to said carrier near an end thereof.

13. The cushioned wristband of claim 12 wherein said fixative comprises a patch of adhesive extending along the strap and for substantially the entirety of the length of the face ply area of said label.

14. A cushioned wristband comprising a wristband carrier, said wristband carrier having a cushion material surface and a loop material surface, a hook strap affixed to the carrier and extending to one side thereof, and a laminated label having a pair of slots arranged along opposite edges thereof, said laminated label having a fixative extending along at least a portion of its length, and said slots being adapted to receive the hook strap therethrough and being the label in close proximity to said fixative.

15. The cushioned wristband of claim 14 wherein said fixative comprises a patch of hook material so as to become affixed to the loop material surface as the strap is wrapped about the wristband carrier.

16. The cushioned wristband of claim 14 wherein said laminated label has a face ply area for receiving a printed image and a laminating ply for laminating the face ply area, the slots being located on opposites sides of said face ply, said slots being formed in said laminating ply.

17. The cushioned wristband of claim 16 wherein said label is formed in a business form, the business form having at least two plies, and wherein each of said face ply area and said laminating ply are formed by die cuts in said two plies.

18. In a cushioned wristband/label assembly, the assembly including a cushioned carrier a strap extending therefrom and an information bearing label, the strap having a length for extending through a pair of slots arranged on opposing sides of the label to bring the label closely adjacent the strap, the improvement comprising a fixative interposed between said label and said strap to adhere and securely position the location of the label with respect to the strap.

19. The cushioned wristband/label assembly of claim 18 wherein the fixative is interposed between the label and either one or both of said strap and cushioned carrier.

20. The cushioned wristband/label assembly of claim 19 wherein a layer of one of a hook or loop material is applied to the cushioned carrier and the other material is applied to the strap and wherein the fixative comprises a patch of the other material applied to the label so that as the strap is wrapped about the cushioned carrier to attach the wristband assembly to a person's appendage, the label and strap affix to the cushioned carrier.

21. The cushioned wristband/label assembly of claim 18 wherein the fixative comprises a patch of adhesive applied to the label.

22. The cushioned wristband/label assembly of claim 18 wherein the fixative comprises a patch of adhesive applied to the strap.

* * * * *